US005934245A

United States Patent [19]

Miller et al.

[11] Patent Number: 5,934,245

[45] Date of Patent: Aug. 10, 1999

[54] TWO CYCLE ENGINE HAVING A MONO-VALVE INTEGRATED WITH A FUEL INJECTOR

[75] Inventors: Charles R. Miller, Metamora; John W. Winkler, East Peoria; Willibald G. Berlinger, Peoria, all of Ill.

[73] Assignee: Caterpillar Inc., Peoria, Ill.

[21] Appl. No.: 08/974,326

[22] Filed: Nov. 19, 1997

[51] Int. Cl.[6] ..... F02M 57/04

[52] U.S. Cl. ..... 123/296

[58] Field of Search ..... 123/296

[56] References Cited

U.S. PATENT DOCUMENTS

| | | | |
|---|---|---|---|
| 2,044,522 | 6/1936 | Wurtele . | |
| 2,071,719 | 2/1937 | Wurtele . | |
| 2,072,437 | 3/1937 | Wurtele | 123/90 |
| 2,082,853 | 6/1937 | Stoikowitz | 123/79 |
| 2,280,386 | 4/1942 | Dickson | 123/296 |
| 3,590,791 | 7/1971 | Roosa | 123/79 |
| 3,606,591 | 9/1971 | Potma | 417/364 |
| 3,613,724 | 10/1971 | Carson | 137/612.1 |
| 3,704,694 | 12/1972 | Gilewski et al. | 123/296 |
| 3,812,829 | 5/1974 | McCormick | 123/296 |
| 4,058,091 | 11/1977 | Tanahashi | 123/32 VN |
| 4,210,064 | 7/1980 | Beerens | 91/394 |
| 4,497,376 | 2/1985 | Kurylko | 173/1 |
| 4,599,861 | 7/1986 | Beaumont | 60/595 |
| 4,640,237 | 2/1987 | Schaich | 123/296 |
| 4,791,786 | 12/1988 | Stuyvenberg | 60/595 |
| 4,809,655 | 3/1989 | Mahler | 123/296 |
| 5,473,893 | 12/1995 | Achten et al. | 60/413 |
| 5,482,445 | 1/1996 | Achten et al. | 417/362 |
| 5,522,358 | 6/1996 | Clarke | 123/296 |
| 5,540,193 | 7/1996 | Achten et al. | 123/46 SC |
| 5,556,262 | 9/1996 | Achten et al. | 417/364 |

FOREIGN PATENT DOCUMENTS

| | | | |
|---|---|---|---|
| 0254353 | 1/1988 | European Pat. Off. | F02B 71/04 |
| 0280200 | 5/1992 | European Pat. Off. . | |
| 1189518 | 1/1958 | France . | |
| 43184 | 4/1938 | Niger . | |
| 6814405 | 4/1970 | Niger . | |
| 1372809 | 11/1974 | United Kingdom | F15B 15/22 |
| WO96/0357 | 2/1996 | WIPO | F02B 71/02 |

OTHER PUBLICATIONS

ADD, Inc., Advanced Design Medium–Speed Engine Announced By ADD, pp. 16, 18–19 of Diesel and Gas Turbine Worldwide, Mar., 1996.

M. Schecter and M. Levin, Camless Engine, pp. 17–31, Published in 1996 by Society of Automotive Engineers, Inc. under doc. No. 960581.

*Primary Examiner*—Erick R. Solis
*Attorney, Agent, or Firm*—Michael McNeil; Larry G. Cain

[57] ABSTRACT

A two cycle engine comprises an engine casing that defines a hollow piston cavity, a first gas passageway and a second gas passageway. The hollow piston cavity is separated from the first gas passageway by a valve seat. A piston is positioned in the hollow piston cavity and is moveable between a top position in which the second gas passageway is blocked to the hollow piston cavity, and a bottom position in which the second gas passageway is open to the hollow piston cavity. A gas valve member is positioned adjacent the valve seat and is moveable between an open position and a closed position relative to the valve seat. The gas valve member defines a nozzle outlet that opens directly into the hollow piston cavity. A needle valve member is positioned in the gas valve member and is moveable between an inject position in which the nozzle outlet is open, and a blocked position in which the nozzle outlet is blocked.

20 Claims, 7 Drawing Sheets

48
61
12
64
60
63
46
67
65
75
66
50
69
54
68
59
70
62
53
71
77
79
76
56
55
51
17
85
19
84
80
86
14
15
16
16

12
65
54
51
17
14
16
16

TWO CYCLE ENGINE HAVING A MONO-VALVE INTEGRATED WITH A FUEL INJECTOR

TECHNICAL FIELD

The present invention relates generally to fuel injectors and gas exchange valves for engines, and more particularly to a two cycle engine with an electronically-controlled mono-valve integrated with a fuel injector.

BACKGROUND ART

Engineers are constantly looking for ways to improve the efficiency and performance of two cycle engines. Several conflicting demands on some engines have placed undesirable spacial limitations relating to the intake or exhaust valve(s) as well as the incorporation of a suitable fuel injection system. In the case of two cycle engines, an ideal scavenging configuration provides for "through flow" or "uni-flow" by the addition of exhaust or inlet valves in the head. However, the addition of the valve train in today's diesel two cycle engines causes two problems: (1) increased manufacture and maintenance costs; and (2) a compromise between the valve location for breathing and optimal location of the injector for combustion.

In addition to the problems identified above, two stroke diesel type free piston engines have particular limitations that are in need of improvement. In general, the power density of a free piston engine can be increased by reducing engine size two ways: (1) a shorter stroke with a proportionally increased frequency; and (2) a reduced piston diameter with increased frequency (accompanied by an increased mean piston speed). The primary limitation to the latter is intake air flow, or scavenging. The power density limitations of the free piston engine could be significantly overcome by incorporating uni-flow scavenging advantages in order to allow for higher mean piston speeds.

In many engines, both the gas exchange valve(s) and the fuel injection system are coupled in their operation to the piston position within the engine. Engineers have recognized that combustion efficiency and overall engine performance can be improved by de-coupling the operation of the fuel injection system from the position of the piston in the engine. In this regard, Caterpillar Inc. of Peoria, Illinois has seen considerable success by incorporating hydraulically-actuated electronically-controlled fuel injectors into engines. These fuel injection systems allow an engine computer to inject a calculated amount of fuel, often in a pre-determined way, into the combustion space in a timing that is based upon sensed operating conditions and other parameters.

In part because of the gains observed by the incorporation of hydraulically-actuated electronically-controlled fuel injectors, engineers believe that further improvements in performance and efficiency can be gained by also de-coupling at least one of the gas exchange valves from the piston position in a two cycle engine. In other words, it is also desirable that at least one of the exhaust or intake valves be electronically-controlled in order to control exhaust and intake portions of the engine cycle in a more independent and efficient manner for a given operating condition.

The present invention is directed to overcoming one or more of the above and other problems, as well as improving the efficiency and performance of two cycle engines in general.

DISCLOSURE OF THE INVENTION

In one aspect of the present invention, an engine comprises an engine casing defining a hollow piston cavity, a first gas passageway and a second gas passageway. The hollow piston cavity is separated from the first gas passageway by a valve seat. A piston is positioned in the hollow piston cavity and is moveable between a top position in which the second gas passageway is blocked to the hollow piston cavity, and a bottom piston in which the second gas passageway is open to the hollow piston cavity. A gas valve member is positioned adjacent valve seat and is moveable between an open position in which a portion of the gas valve member is away from the valve seat, and a closed position at which the portion is seated against the valve seat. The gas valve member defines a nozzle outlet that opens directly into the hollow piston cavity. A needle valve member is positioned in the gas valve member and is moveable between an inject position in which the nozzle outlet is open, and a blocked position in which the nozzle outlet is blocked.

In another aspect of the present invention, the valve seat surrounds a centerline. The hollow piston cavity, gas valve member and the piston define a combustion chamber.

In still another aspect of the present invention, the engine includes a fuel injector having a needle valve member, a hydraulic actuator and an injector body that defines a fuel pressurization chamber that opens to a nozzle outlet. The needle valve member is positioned in the injector body and moveable between an inject position in which the fuel pressurization chamber is open to the nozzle outlet, and a blocked position in which the fuel pressurization chamber is blocked to the nozzle outlet. A portion of the injector body adjacent the nozzle outlet is a gas valve member positioned adjacent the valve seat. The gas valve member is moveable between an open position in which a portion of the gas valve member is away from the valve seat, and a closed position in which the portion is seated against the valve seat. The hollow piston cavity, the gas valve member and the piston define a combustion chamber.

BEST MODE FOR CARRYING OUT THE INVENTION

Figure 1:
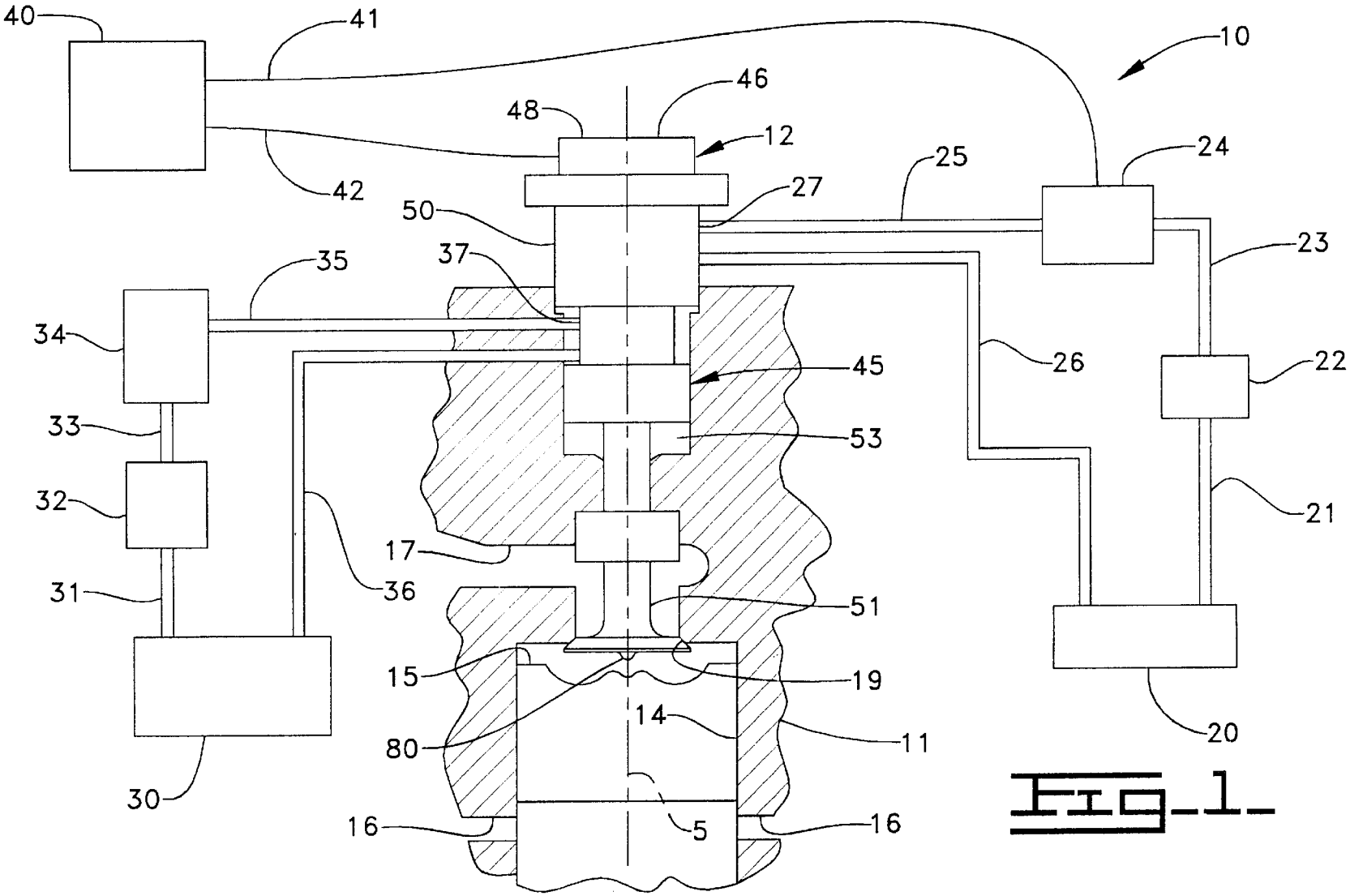
FIG. 1 is a partial schematic view of an engine and fuel injection system according to one embodiment of the present invention.
Figure 2A:
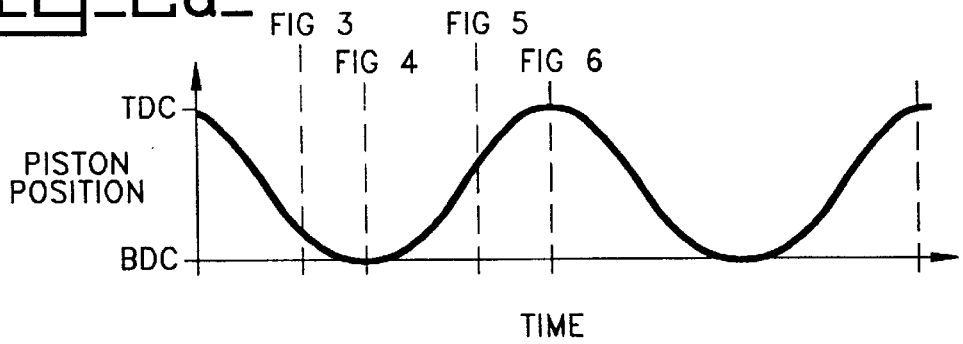
FIGS. 2*a–d* graphically show various parameters including piston position, gas valve member position, needle valve member position and solenoid, respectively, versus time for a two cycle engine according to one example aspect of the present invention.
Figure 2B:
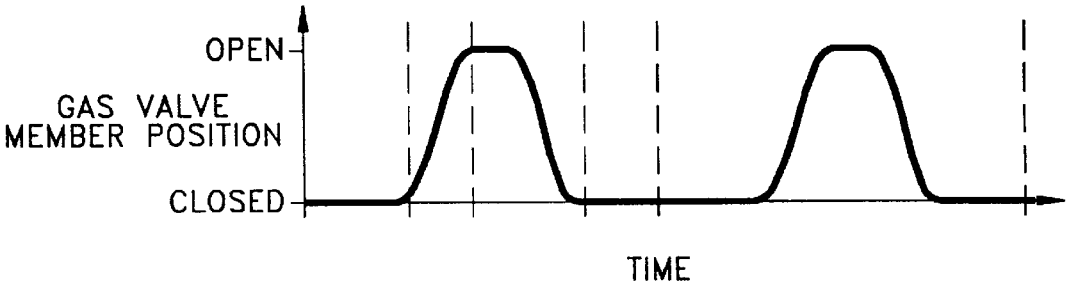
Figure 2C:
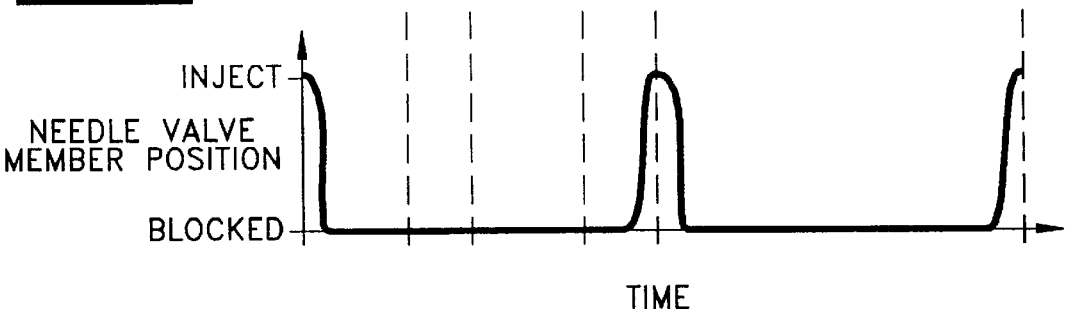
Figure 2D:
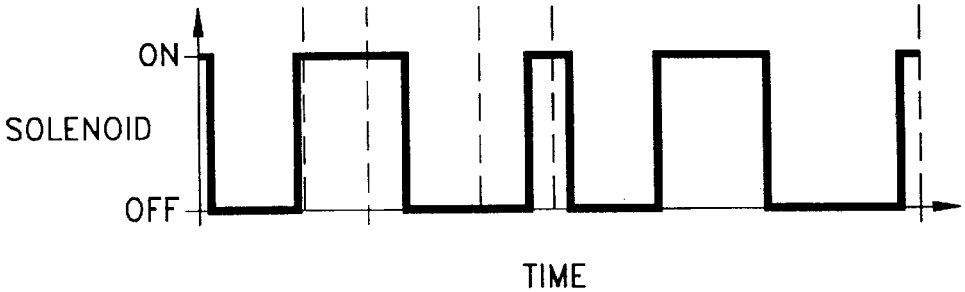

Referring now to FIG. 1, an engine 10 includes an integrated fuel injector and cylinder valve 12 mounted in an engine casing 11. In this example embodiment, engine 10 is adapted as a two stroke diesel type engine. Engine casing 11 defines a cylindrically shaped hollow piston cavity 14 separated from an intake gas passageway 17 by a valve seat 19. A plurality of exhaust gas passageways 16 open into hollow piston cylinder 14 at a plurality of positions distributed around centerline 5. As in a conventional engine, a piston 15 is positioned in hollow piston cavity 14 and is moveable by a crank shaft (not shown) between a bottom dead center position and a top dead center position, as shown. Exhaust gas passageway 16 are normally blocked to the combustion chamber defined by hollow piston cavity in piston 15 but are open to same when piston 15 is in its bottom dead center position. Integrated fuel injector and cylinder valve 12, hollow piston cylinder 14 and piston 15 all share a common centerline 5.

Integrated fuel injector and cylinder valve 12 utilizes a hydraulic actuator 46, which is preferably activated by a single solenoid 48, to control and power fuel injector 45 as well as the movement of mono gas valve member 51. Thus, hydraulic actuator 46 is coupled to both fuel injector 45 and gas valve 51. Mono gas valve member 51 is a portion of injector body 50, and is moved by hydraulic actuator 46 with respect to a remaining portion of injector body 50 to open and close hollow cylinder cavity 14 to intake gas passageway 17 across valve seat 19. Hollow piston cavity 14, piston 15 and gas valve member 51 define the combustion chamber. Fuel is supplied to integrated fuel injector and cylinder valve 12 at a fuel inlet 37, and a relatively high pressure actuation fluid, such as engine lubricating oil, is supplied to hydraulic actuator 46 at actuation fluid inlet 27. Solenoid 48 is attached to a control valve 61 (FIG. 3) within integrated fuel injector and cylinder valve 12 and is the means by which actuation fluid inlet 27 is opened and closed. In turn, the activation of solenoid 48 is controlled by a conventional electronic control module 40 via a communication line 42.

Actuation fluid inlet 27 receives relatively high pressure actuation fluid via supply passage 25, which is connected to a high pressure pump 24. A relatively low pressure circulation pump 22 draws low pressure actuation fluid from reservoir 20, into circulation passage 21 and on to high pressure pump 24 via actuation fluid supply passage 23. Electronic control module 40 controls the magnitude of the actuation fluid pressure by controlling high pressure pump 24 via communication line 41. By controlling the pressure of the actuation fluid, an additional element of control over the integrated fuel injector and cylinder valve 12 is gained. After doing work within hydraulic actuator 46, actuation fluid is returned to reservoir 20 via an actuation fluid return passage 26. Those skilled in the art will appreciate that any available fluid could be used to power hydraulic actuator 46, including but not limited to lubricating oil, fuel fluid, coolant fluid, etc.

Fuel is supplied to fuel injector 45 via a fuel supply passage 35 that is connected at one end to fuel inlet 37 and on its other end to a fuel circulation pump 34. Fuel circulation pump 34 draws fuel from fuel tank 30, along fuel circulation passage 31, through fuel filters 32 and eventually into pump 34 via fuel supply passage 33. Any fuel not used during the regular operating cycle of integrated fuel injector control valve 12 is recirculated to fuel tank 30 via fuel return passage 36.

Figure 3:
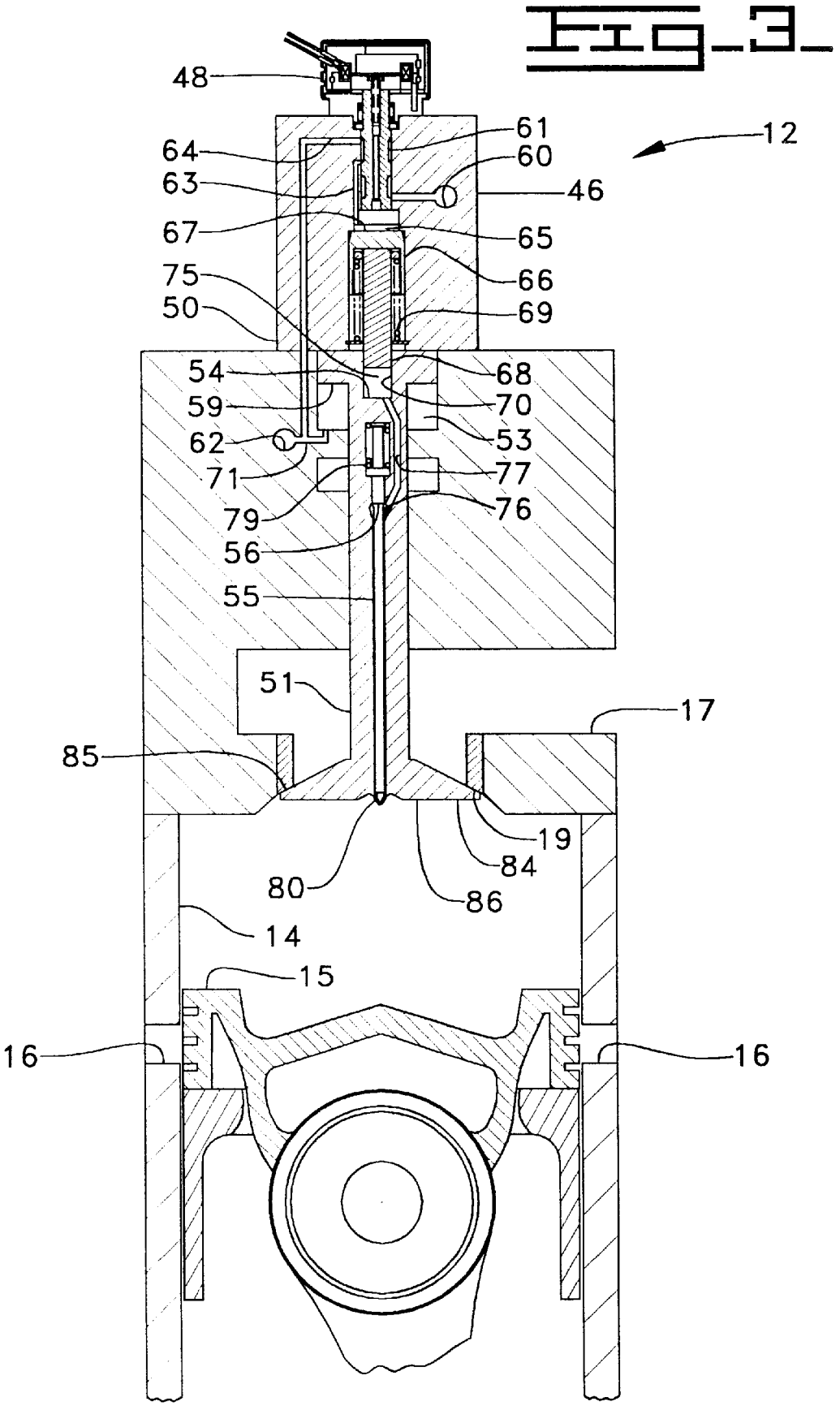
FIG. 3 is a partial diagrammatic sectioned side elevational view of an engine and fuel injection system according to the present invention during a power portion of an engine cycle.

Referring now to FIG. 3, the inwardly opening valve system includes valve portion 86 of gas valve member 51 that is positioned in hollow piston cavity 14. During combustion and injection events, valve contact surface 85 is held in contact with valve seat 19 to isolate the combustion space from intake gas passageway 17. Also as in a conventional valving system, compression and combustion pressure acting on closing pressure surface 84 of gas valve member 51 serves to hold the same closed during compression and combustion events. Gas valve member 51 is normally biased towards a closed position, as shown in FIG. 3, by a lower pressure fluid acting on a gas valve return shoulder 59 that is positioned within gas valve biasing chamber 53.

The remaining portions of the internal structure of integrated fuel injector and control valve 12 are substantially similar to hydraulically-actuated electronically-controlled fuel injectors of the type manufactured by Caterpillar Inc. of Peoria, Ill. and described in detail in numerous issued patents. Nevertheless, injector body 50 includes an actuation fluid inlet conduit 60 that opens on one end to the actuation fluid inlet 27 shown in FIG. 1. A solenoid actuated control valve 61 is positioned between the actuation fluid inlet conduit 60 and actuation fluid cavity 65. Solenoid actuated control valve 61 is attached to and moved by solenoid 48. When the solenoid is activated, control valve 61 moves to a first position in which activation fluid inlet conduit 60 is open to actuation fluid cavity 65 via connection passage 63. Control valve 61 is normally biased to a second position via any conventional means, such as a spring (not shown) such that actuation fluid cavity 65 is connected to drain passage 62 via connection passages 63 and 64. Referring back in addition to FIG. 1, drain passage 62 is connected on the outer surface of injector body 50 to the actuation fluid return passage 26.

Figure 4:
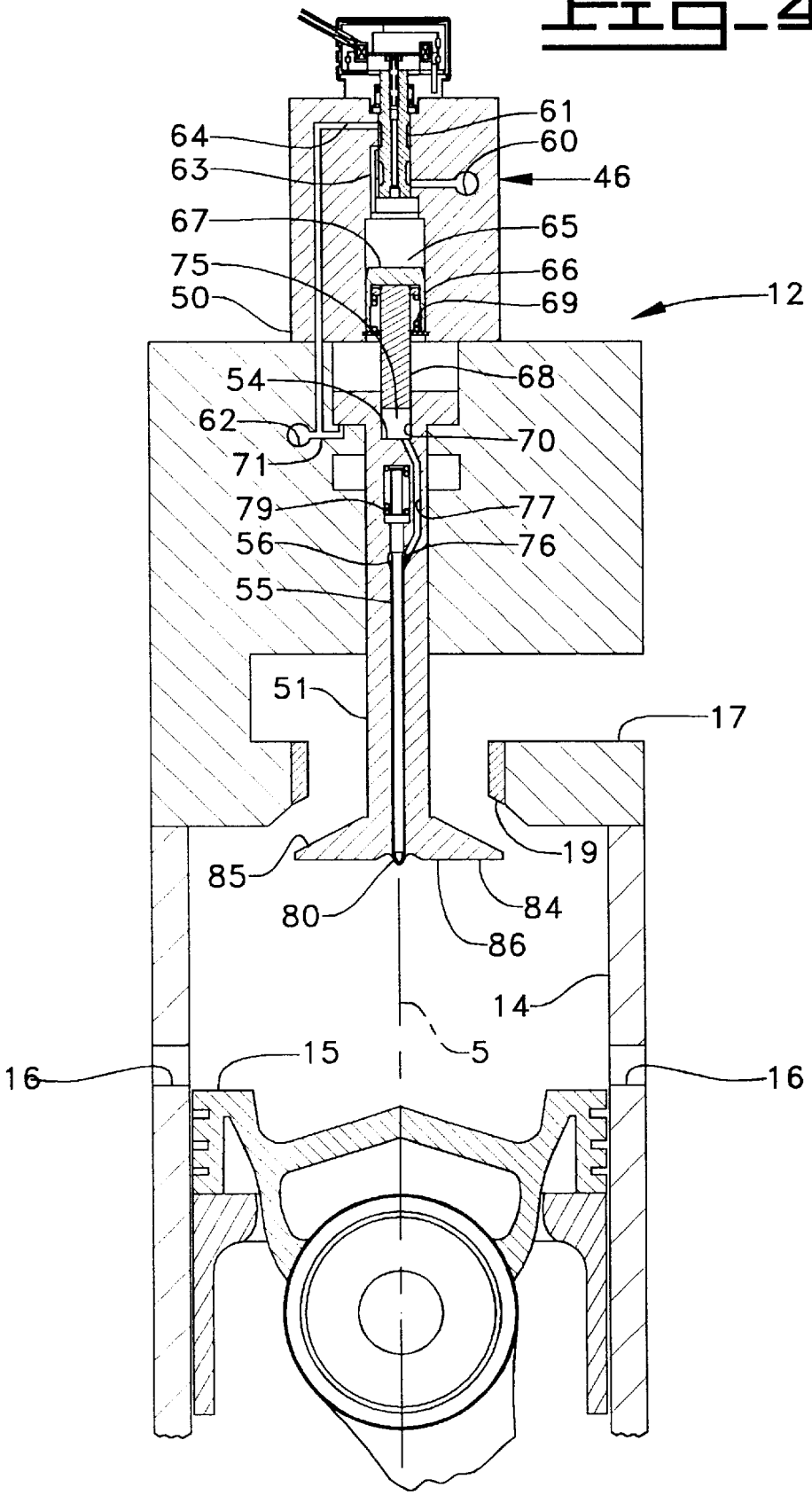
FIG. 4 is a diagrammatic view similar to FIG. 3 except showing the piston at bottom dead center when in the scavenging portion of the engine cycle.

An intensifier piston 66 is positioned in actuation fluid cavity 65 and is moveable between a retracted position as shown in FIG. 3 and an advanced position as shown in FIG. 4. Intensifier piston 66 includes a top hydraulic surface 67 that is acted upon by the fluid pressure existing within actuation fluid cavity 65. Actuation fluid control valve 61 along with actuation fluid cavity 65 and intensifier piston 66, as well as the associated passageways, constitute the hydraulic actuator 46 according to the present invention.

Gas valve member 51 includes a plunger bore 70, within which a plunger 68 reciprocates between an advanced position and a retracted position. Plunger 68 is connected to the underside of intensifier piston 66 such that both are biased toward their respective retracted positions by a return spring 69. The bottom of plunger bore 70 is an opening pressure surface 54 for gas valve member 51. Opening pressure surface 54 is sized in relation to closing pressure surface 84 such that gas valve member 51 will move to its open position as shown in FIG. 4 when fuel pressure acting on opening pressure surface 54 is sufficient to overcome any counter force resulting from gas pressure acting on closing pressure surface 84 within hollow piston cavity 14. These two pressure surfaces are sized such that gas valve member 51 can only move to its open position when pressure within hollow piston cavity 14 is at its relatively low gas exchange pressure. When pressure within hollow piston cavity is at its relatively high compression or even higher combustion pressures, the pressure surfaces 54 and 84 are sized such that gas valve member 51 cannot move to its open position. As stated earlier, gas valve member 51 is only biased toward its closed position by the relatively low pressure existing in drain passage 62, which is connected to gas valve biasing chamber 53 via a biasing connection passage 71. It is important to note that the travel distance of piston 66 from its retracted position to its advanced position is such that it is in contact with its bottom stop when gas valve member 51 is in its open position. This travel distance prevents further movement of intensifier piston 66 so that no fuel is injected into hollow piston cylinder 14 when gas valve member 51 is in its open position.

When the gas pressure within hollow piston cavity 14 that is acting upon closing pressure surface 84 is sufficient to hold gas valve member 51 closed, the remaining portions of integrated fuel injector and control valve 12 behaves essentially as a hydraulically-actuated fuel injector. In particular, plunger 68, plunger bore 70 and opening pressure surface 54 all define a fuel pressurization chamber 75 that is connected to a nozzle chamber 76 via a nozzle supply passage 77. In turn, nozzle chamber 76 is open to nozzle outlet 80, which opens directly into hollow piston cylinder 14. It is important to note that nozzle outlet 80 is preferably positioned at the approximate center of valve portion 86 and hollow piston cavity 14 in order to optimize combustion.

A needle valve member 55 is positioned within gas valve member 51 and is moveable between an inject position in which nozzle chamber 76 is open to nozzle outlet 80, and a blocked position in which nozzle chamber 76 is blocked to nozzle outlet 80. Preferably, needle valve member 55, gas valve member 51 and piston 15 all move along common centerline 5. Needle valve member 55 is normally biased toward its blocked position by a needle return spring 79, but is capable of moving to its inject position when fuel pressure acting on lifting hydraulic surface 56 reaches a valve opening pressure sufficient to overcome needle return spring 79. As in a conventional fuel injector, the valve opening pressure is between a relatively low fuel supply pressure and a relatively high injection pressure. It is important to note that the magnitude of fuel pressure necessary to move gas valve member 51 to its open position is significantly lower than the valve opening pressure necessary to lift needle valve member 55 to its inject position. Thus, opening pressure surface 54, closing pressure surface 84 and lifting hydraulic surface 56 are all sized relative to one another, and appropriate travel distances of the components are defined such that: (1) fuel is not injected into hollow piston cavity 14 when gas valve member 51 is in its open position; (2) only one of either the gas valve member 51 or the needle valve member 55 are moved when hydraulic actuator 46 is activated; (3) gas valve member 51 remains closed when pressure in hollow piston cavity 14 is relatively high during compression and combustion; and (4) needle valve member 55 is capable of being lifted to its inject position only when gas valve member 51 is held in its closed position by high pressure within hollow piston cavity 14.

Figure 7:
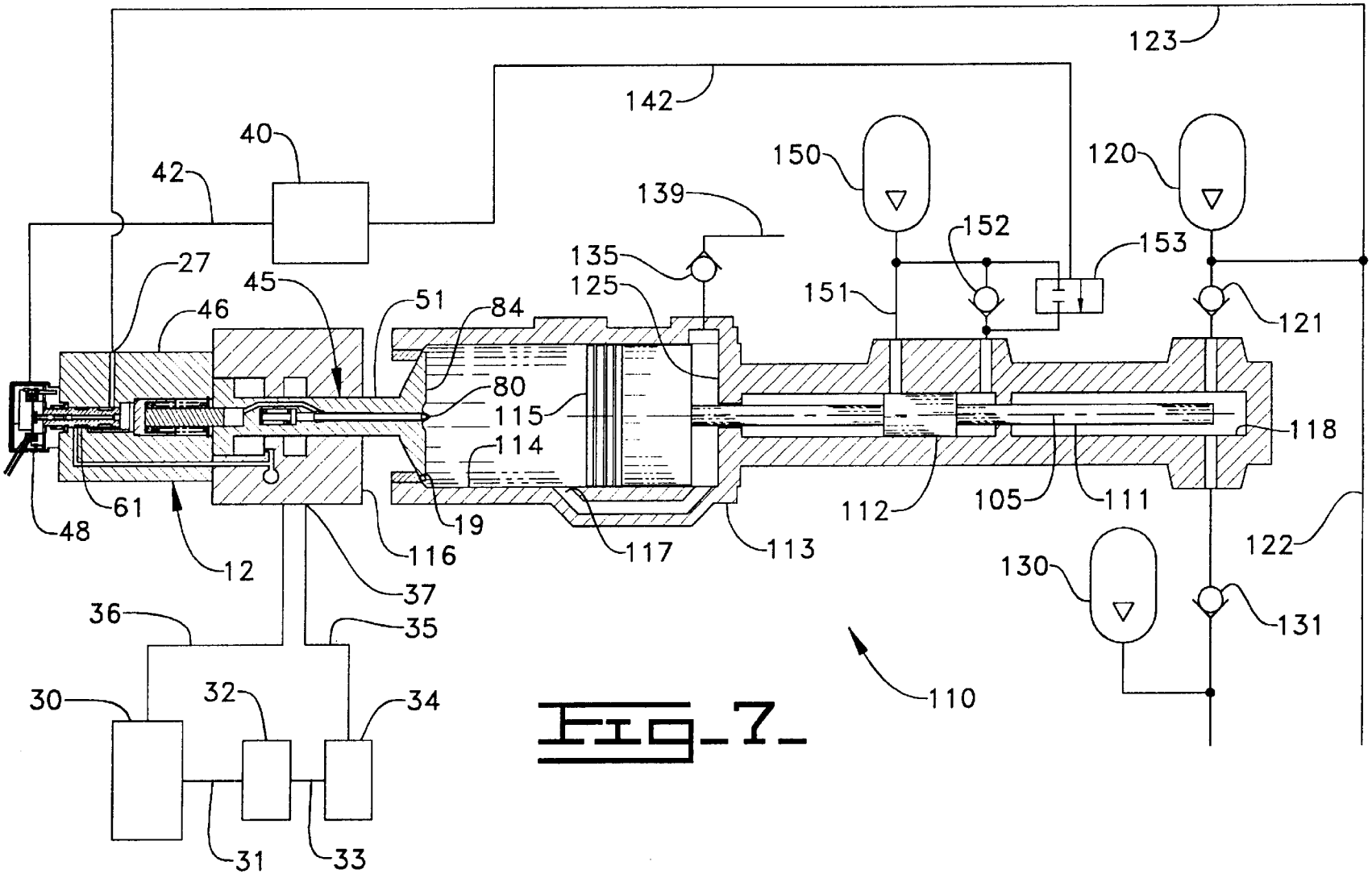
FIG. 7 is a diagrammatic partial schematic view of a free piston two cycle engine according to another embodiment of the present invention.

Referring now to FIG. 7, another embodiment of the present invention in the form of a two cycle free piston engine 110 is illustrated. Many of the features of engine 110 are similar to those features already discussed with regard to the crank shaft type engine. These features include the integrated fuel injector and cylinder valve 12 as well as the fuel circulation systems, and identical numbers are used to identify these features. Reference is made to the earlier description for a discussion of these identical features.

Free piston engine 110 includes an engine casing 113 that defines a hollow piston cavity 114, within which a piston 115 is positioned to move between a bottom position, as shown, and a top position. Engine casing 113 defines an intake gas passageway 117 that opens into hollow piston cavity 114 when piston 115 is in its bottom position as shown, but is blocked to the combustion space when piston 115 moves toward its top position. Although not visible in this view, there are preferably several intake gas passageways distributed around common centerline 105. Engine casing 113 also includes an exhaust gas passageway 116 that is alternately opened and closed to hollow piston cavity 114 by gas valve member 51. With each reciprocation of piston 115, fresh air is drawn into fresh air cavity 125, past one way valve 135 and through air intake passage 139. This air is compressed within fresh air cavity 125 when piston 115 moves to its bottom position.

Attached to piston 115 is a work plunger 111 that includes an enlarged portion 112. When piston 115 moves from its top position to its bottom position, as shown, fluid, such as lubricating oil, is compressed within pump chamber 118 and pushed into high pressure accumulator 120 past one way valve 121. A portion of the high pressure fluid in accumulator 120 is supplied to hydraulic actuator 46 via actuation fluid supply passage 123. Another portion of the high pressure fluid in accumulator 120 is supplied to high pressure conduit 122 where it does work with some item of machinery (not shown).

The electronic control module 40 not only controls the activation of integrated fuel injector and cylinder valve 12 but also controls the initiation of piston 115's movement by controlling compression starter valve 153 via a conventional communication line 142. When compression starter valve 153 is commanded to open, medium pressure fluid flows from compression pressure accumulator 150 to act upon the enlarged portion 112 of work plunger 111. This starts work plunger 111 and piston 115 moving to the left until enlarged portion 112 moves past open conduit 151 to increase the flow of medium pressure fluid from compression pressure accumulator 150. The fluid pressure within pressure accumulator 150 is preferably high enough to push piston 115 to its top position to compress the fresh air for a subsequent combustion event. When piston 115 moves to the right, a portion of the fluid is recovered to compression accumulator 150 through open conduit 151 as well as past one way valve 152. Any fluid pressure losses in pressure accumulator 150 can be made up in a manner known in the art, such as by a pump or a fluid connection (not shown) between accumulator 150 and high pressure accumulator 120.

With each reciprocation of piston 115 and work plunger 111, fluid is re-supplied to work chamber 118 from a low pressure accumulator 130 via one way valve 131.

INDUSTRIAL APPLICABILITY

Referring now to FIGS. 2–6, the operation of engines 10 and 110 are generally illustrated for a two stroke diesel type engine cycle. The vertical dotted lines on FIGS. 2*a–d* illustrate where the snap shot illustrations of FIGS. 3–7 are taken during the engine cycle. FIG. 3 shows the engine when the piston 15 is moving downward during the power portion of the engine cycle toward its bottom dead center position. As the piston continues its downward movement to its bottom dead center position, exhaust passageways 16 become open and the residual pressure within the combustion space is relieved and a substantial amount of the burnt gases escape through exhaust passageway 16. In the case of the free piston engine shown in FIG. 7, the mono-valve opens first because in that example embodiment the exhaust passage 116 is opened and closed by the mono-valve 51 rather than by the piston as in the first embodiment.

As the piston 15 continues its movement and reaches its bottom dead center position, the solenoid 48 is energized and the mono-valve 51 is moved to its open position in order to open the intake passage 17 to the combustion space. During this scavenging portion of the engine cycle, fresh air is passed into hollow piston cavity in a uni-flow direction such that the remaining burnt exhaust gases are expelled through the exhaust passage 16. In the case of the free piston engine 110 of FIG. 7, the compressed fresh air in the fresh air cavity 125 is released into hollow piston cavity 114 in order to push any remaining exhaust gases past mono-valve 151 into exhaust passageway 116 to fill cavity 115 with fresh air for the next compression/combustion cycle. The scavenging air flow is from top to bottom in the embodiment illustrated in FIGS. 1 and 3–6, whereas the scavenging air flow is from bottom to top in the free piston engine shown in FIG. 7. The reason being that the intake and exhaust passageways are reversed in the two examples. This illustrates that the mono-valve of the present invention can be used either to open and close an intake gas passageway as in the first engine 10 or as an exhaust gas passage as in the free piston engine 110 shown in FIG. 7.

Figure 5:
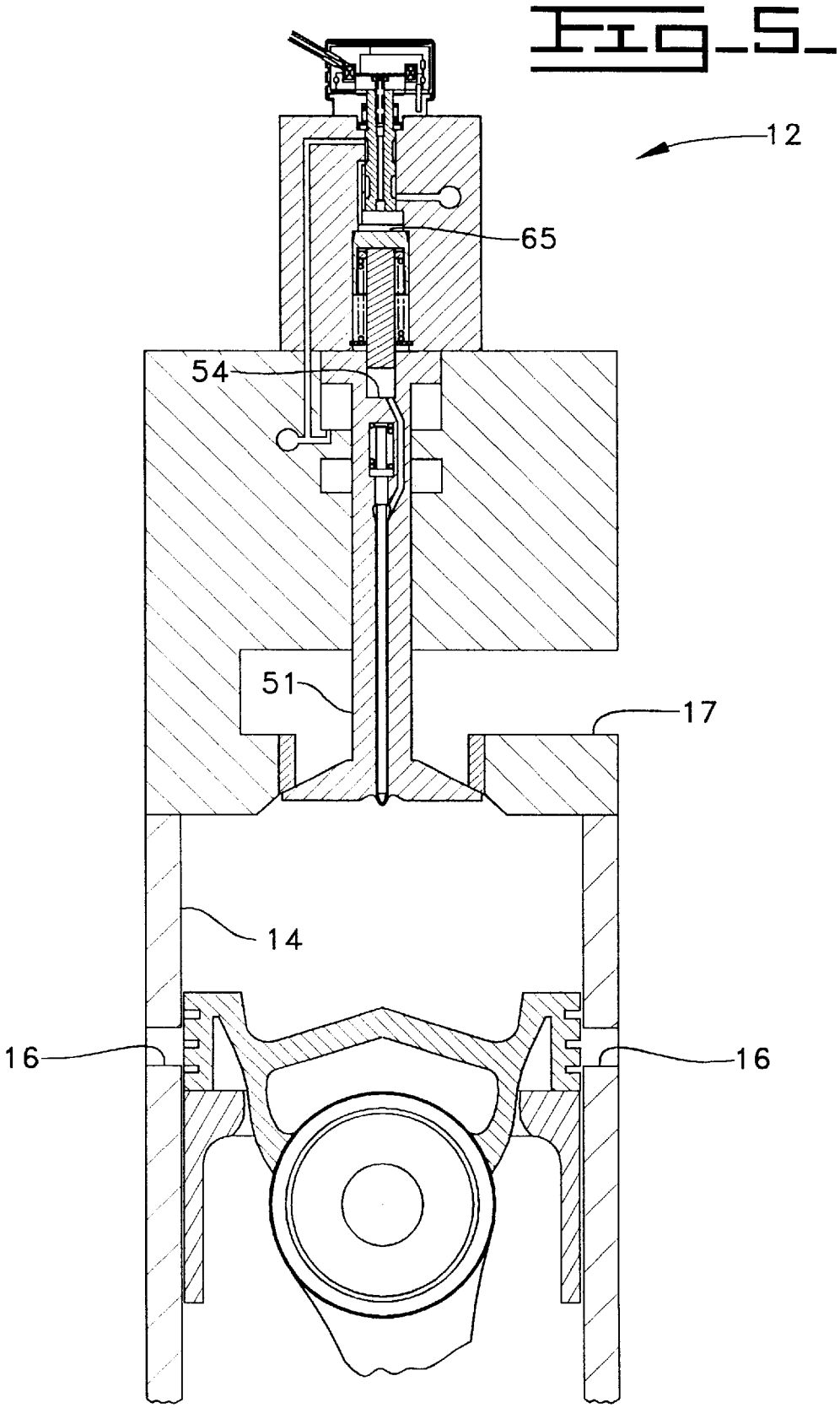
FIG. 5 is a diagrammatic view similar to FIGS. 3 and 4 showing the engine in the compression portion of the engine cycle.
Figure 6:
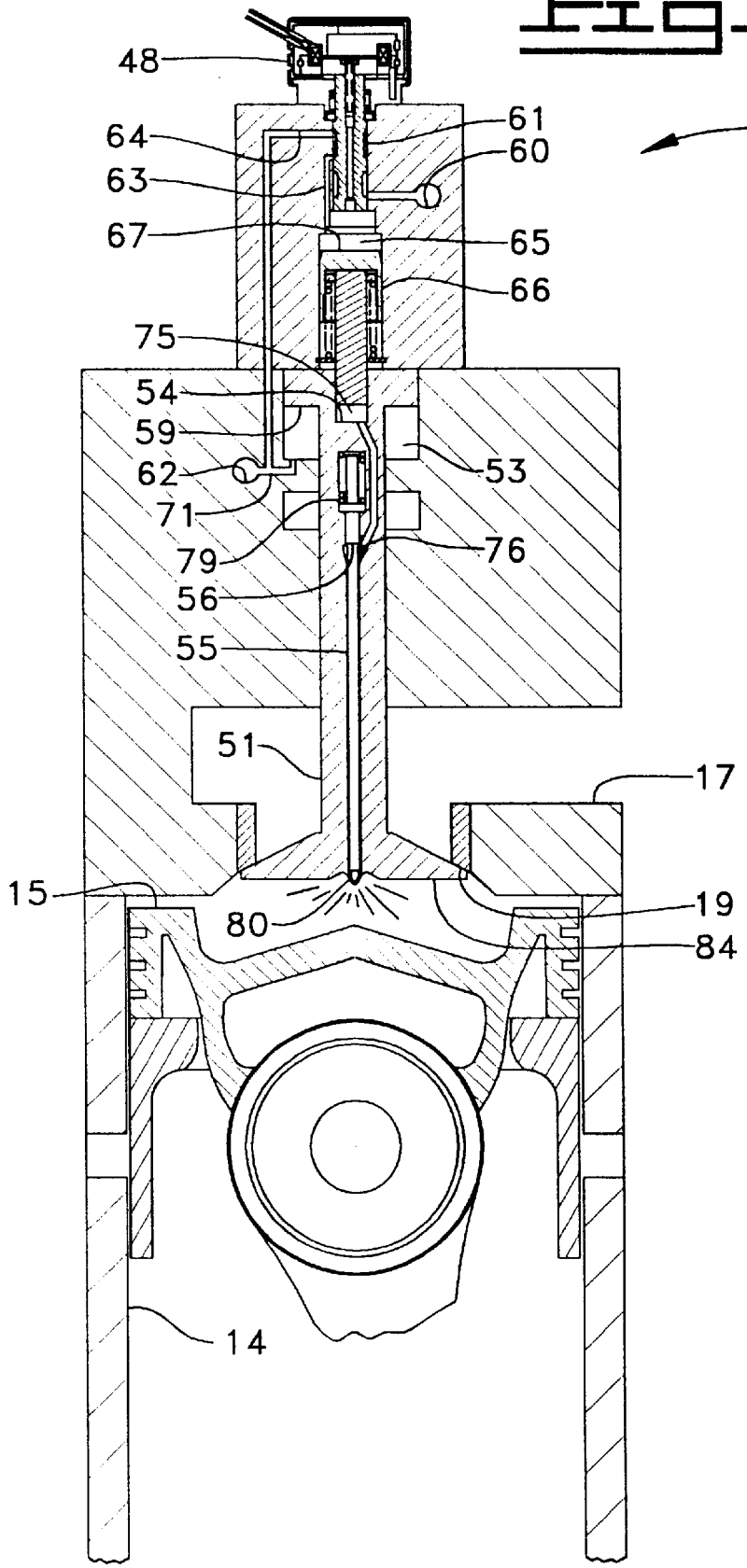
FIG. 6 is a diagrammatic view similar to FIGS. 3–5 except showing the engine and fuel injection system in the injection portion of the engine cycle.

Referring now to FIG. 5, after the scavenging is complete, the piston moves upward in the compression portion of the engine cycle. This movement closes exhaust passage 16. At the same time, the solenoid is de-energized to close mono-valve 51. Thus, during this portion of the engine cycle the combustion space within hollow piston cavity 14, or 114 in the case of engine 110, is closed and pressure builds leading up to the injection event illustrated in FIG. 6.

When the piston is at or near its top dead center position as shown in FIG. 6, the solenoid is again energized in order to initiate the injection event. Because pressure within the combustion space is relatively high, the high pressure acting on closing pressure surface 84 is also high, and thus the mono-valve 51 is unable to move to its open position. Instead, the downward movement of piston 66 causes fuel pressure to build within fuel pressurization chamber 75. Eventually this fuel pressure reaches a valve opening pressure sufficient to lift needle valve member 55 against the action of return spring 79 causing the fuel injection event to commence.

The injection event is ended by de-energizing the solenoid to close control valve 61 so that actuation fluid pressure on the top surface 67 of intensifier piston 66 is relieved. When fluid pressure in actuation fluid cavity 65 is relieved, fuel pressure within fuel pressurization chamber 75 eventually drops below a valve closing pressure. This results in needle valve member 55 moving back to its blocked position under the action of biasing spring 79 to end the injection event.

During the downward power stroke of piston 15, intensifier piston 66 and plunger 68 are reset into their respective retracted positions under the action of return spring 69. This resets integrated fuel injector and mono-valve 12 for the next scavenging portion of the engine cycle. When the power stroke is nearly completed, and a subsequent scavenging portion of the engine cycle begins, the solenoid is again energized and the high pressure actuation fluid flows into actuation fluid cavity 65 to again act upon intensifier piston 66. This again pressurizes fuel in fuel pressurization chamber 75. However, because pressure within the combustion space is lower, mono-valve 51 is able to move to its open position since the pressure acting on opening pressure surface 54 is greater than the residual pressure force acting on closing pressure surface 84 within the combustion space. Thus, mono-valve 51 moves to its open position and the next scavenging portion of the engine cycle commences.

The integrated fuel injector and mono cylinder valve of the present invention addresses several major problems existing in two cycle engine designs. First of all, in the preferred embodiment both the mono valve and the fuel injector are electronically controlled so that the actuation of both subsystems can be accomplished independent of the piston position. This enables the operation of the engine to be optimized for various operating conditions and other environmental factors. In addition, by exploiting pressure conditions existing in the hollow piston cylinder, the mono valve and the fuel injector can be operated independent of one another since their respective actuations take place during different portions of the engine's operating cycle. The mono valve design also eliminates the conflicting spacial requirements of the fuel injector and valving subsystems. In other words, it allows the fuel injector to be located at an optimal central location in the combustion chamber without compromise to the porting and valve locations necessary for engine breathing. The mono valve also provides a relatively large flow area and thus eliminates the need for piston valve pockets and other compromises in the combustion chamber of a compression ignition diesel type engine. Those skilled in the art will appreciate that some of the advantages of the present invention can still be retained if a conventional cam actuator were substituted for the preferred hydraulic actuator illustrated in the drawings.

The incorporation of the mono-valve into a two stroke compression ignition engine also provides an ideal scavenging configuration by producing a through flow or uni-flow by the addition of one of either the exhaust or inlet passageway in the head. In addition, the integration of the mono-valve with a fuel injector provides the advantages of uni-flow scavenging at a lower manufacturing cost and part count than current two stroke uni-flow designs can accomplish without compromise to the valve and injector location. In the case of a two stroke free piston engine, the power density can be increased by the use of a mono-valve, since the uni-flow design makes possible the use of a shorter piston stroke as well as a reduced piston diameter without a decrease in power output from the engine. In addition, both of these advantages can be accomplished at lower cost than current designs. In particular, the valve and the head allows for full circumference to be available for single function porting (exhaust or intake), thus reducing the length of stroke required to obtain a proper port flow area. In addition, the improved uni-flow scavenging allows for higher mean piston speeds.

Those skilled in the art will appreciate the numerous modifications and alternative embodiments of the present invention will be apparent in view of the foregoing description. For instance, the present invention could be used in either a two cycle free piston or crank shaft type engine. In addition, the system could be modified to a cam actuated system as discussed earlier, or the present invention could be incorporated into one or more valves of a multi valve engine system. Accordingly, the above description is to be construed as illustrative only, and is for the purpose of teaching those skilled in the art the best mode of carrying out the invention. The details of the structure may be varied substantially without departing from the spirit of the invention, the scope of which is defined in terms of the claims as set forth below.

We claim:

1. An engine comprising:

an engine casing defining a hollow piston cavity, a first gas passageway and a second gas passageway, and said hollow piston cavity being separated from said first gas passageway by a valve seat;

a piston positioned in said hollow piston cavity and being movable between a top position in which said second gas passageway is blocked to said hollow piston cavity, and a bottom position in which said second gas passageway is open to said hollow piston cavity;

a gas valve member positioned adjacent said valve seat and being movable between an open position at which a portion of said gas valve member is spaced from said valve seat, and a closed position in which said portion is seated against said valve seat;

said gas valve member defining a nozzle outlet that opens directly into said hollow piston cavity; and a needle valve member positioned in said gas valve member and being movable between an inject position in which said nozzle outlet is open, and a blocked position in which said nozzle outlet is blocked.

2. The engine of claim 1 wherein said hollow piston cavity has a centerline; and said valve seat is a single valve seat that surrounds said centerline.

3. The engine of claim 1 further comprising a hydraulic actuator coupled to said gas valve member.

4. The engine of claim 1 wherein one of said first gas passageway and said second gas passageway is an intake passage; and the other of said first gas passageway and said second gas passageway is an exhaust passage.

5. The engine of claim 1 wherein said piston is attached to a work plunger.

6. The engine of claim 1 further comprising a needle biasing spring positioned to bias said needle valve member toward said blocked position;

a hydraulic actuator coupled to said gas valve member;

at least one of said engine casing, said gas valve member and said hydraulic actuator defining a fuel pressurization chamber that opens to a nozzle chamber;

said needle valve member has a lifting hydraulic surface exposed to fluid pressure in said nozzle chamber; and said gas valve member has a closing pressure surface exposed to fluid pressure in said hollow piston cavity, and an opening pressure surface exposed to fluid pressure in said fuel pressurization chamber.

7. The engine of claim 6 wherein said fuel pressurization chamber cycles between a relatively low fuel pressure and a relatively high injection pressure during each engine cycle;

a valve opening pressure lies between said relatively low fuel pressure and said relatively high injection pressure;

said hollow piston cavity cycles between a relatively high compression pressure and a relatively low gas exchange pressure during each engine cycle;

said lifting hydraulic surface, said closing pressure surface and said opening pressure surface are sized relative to one another in a relation that is dependent upon said relatively high compression pressure, said relatively low gas exchange pressure and said valve opening pressure.

8. The engine of claim 1 further comprising a hydraulic actuator coupled to said gas valve member; and said hydraulic actuator being connected to a source of actuation fluid that is different from fuel.

9. The engine of claim 1 wherein said second gas passageway is separated from said hollow piston cavity by a plurality of openings distributed around said centerline.

10. An engine comprising:

an engine casing defining a hollow piston cavity with a centerline, a first gas passageway and a second gas passageway, and said hollow piston cavity being separated from said first gas passageway by a valve seat disposed about said centerline;

a piston positioned in said hollow piston cavity and being movable between a top position at which said second gas passageway is blocked to said hollow piston cavity, and a bottom position at which said second gas passageway is open to said hollow piston cavity;

a gas valve member positioned adjacent said valve seat and being movable between an open position at which a portion of said gas valve member is away from said valve seat, and a closed position at which said portion is seated against said valve seat;

said hollow piston cavity, said gas valve member and said piston defining a combustion chamber;

said gas valve member defining a nozzle outlet that opens directly into said combustion chamber; and a needle valve member positioned in said gas valve member and being movable between an inject position in which said nozzle outlet is open, and a blocked position in which said nozzle outlet is blocked.

11. The engine of claim 10 wherein said piston, said gas valve member and said needle valve member all move along said centerline.

12. The engine of claim 11 wherein one of said first gas passageway and said second gas passageway is an intake passage; and the other of said first gas passageway and said second gas passageway is an exhaust passage.

13. The engine of claim 12 wherein said second gas passageway is separated from said hollow piston cavity by a plurality of openings distributed around said centerline.

14. The engine of claim 13 further comprising a hydraulic actuator coupled to said gas valve member; and said hydraulic actuator being connected to a source of actuation fluid that is different from fuel.

15. The engine of claim 14 wherein said gas valve member is a portion of an injector body that defines a fuel pressurization chamber that opens to said nozzle outlet;

said needle valve member has a lifting hydraulic surface exposed to fluid pressure in said fuel pressurization chamber; and said gas valve member having a closing pressure surface exposed to fluid pressure in said hollow piston cavity, and an opening pressure surface exposed to fluid pressure in said fuel pressurization chamber.

16. An engine comprising:

an engine casing defining a hollow piston cavity, a first gas passageway and a second gas passageway, and said hollow piston cavity being separated from said first gas passageway by a valve seat;

a piston positioned in said hollow piston cavity and being movable between a top position in which said second gas passageway is blocked to said hollow piston cavity, and a bottom position in which said second gas passageway is open to said hollow piston cavity;

a work plunger attached to said piston;

a fuel injector having a needle valve member, a hydraulic actuator and an injector body defining a fuel pressurization chamber that opens to a nozzle outlet;

said needle valve member being positioned in said injector body and moveable between an inject position in which said fuel pressurization chamber is open to said nozzle outlet, and a blocked position at which said fuel pressurization chamber is blocked to said nozzle outlet;

a portion of said injector body adjacent said nozzle outlet being a gas valve member positioned adjacent said valve seat and being movable between an open position at which a portion of said gas valve member being spaced from said valve seat, and a closed position at which said portion is seated against said valve seat; and said hollow piston cavity, said gas valve member and said piston defining a combustion chamber.

17. The engine of claim 16 wherein said gas valve member has an opening pressure surface exposed to fluid pressure inside said injector body;

said gas valve member has a closing pressure surface exposed to fluid pressure outside said injector body;

said needle valve member has a lifting hydraulic surface exposed to fluid pressure in said fuel pressurization chamber; and said lifting hydraulic surface, said closing pressure surface and said opening pressure surface are sized relative to one another.

18. The engine of claim 17 wherein said hydraulic actuator is connected to a source of actuation fluid that is different from fuel.

19. The engine of claim 18 wherein said second gas passageway is separated from said hollow piston cavity by a plurality of openings distributed around a centerline; and said piston, said gas valve member and said needle valve member all move along said centerline.

20. The engine of claim 19 wherein one of said first gas passageway and said second gas passageway is an intake passage; and the other of said first gas passageway and said second gas passageway is an exhaust passage.

* * * * *

UNITED STATES PATENT AND TRADEMARK OFFICE

CERTIFICATE OF CORRECTION

PATENT NO. : 5,934,245

DATED : August 10, 1999

INVENTOR(S) : Miller et al.

It is certified that error appears in the above-identified patent and that said Letters Patent is hereby corrected as shown below:

In Claim 1, line 16, please delete the word "and".

In Claim 1, line 20, please delete the punctuation mark "." following the word "blocked", and insert in its place the phrase --; and an electronically controlled actuator coupled to said gas valve member.--.

In Claim 3, lines 1-2, following the phrase "claim 1", please delete the phrase "further comprising a hydraulic actuator coupled to said gas valve member.--.

In Claim 3, line 1, following the phrase "claim 1", please insert the phrase --wherein said electronically controlled actuator is a hydraulic actuator.--.

In Claim 6, line 4, please delete the phrase "a hydraulic actuator coupled to said gas valve member;" and insert in its place the phrase --said electronically controlled actuator being a hydraulic actuator;--

In Claim 7, line 8, after the phrase "during each engine cycle;", please insert the word --and--.

In Claim 8, line 1, after the phrase "claim 1", please delete the phrase "further comprising a hydraulic actuator coupled to said gas valve member" and insert in its place the phrase --wherein said electronically controlled actuator is a hydraulic actuator--.

In Claim 10, line 18, after the phrase "combustion chamber;", please delete the word "and".

UNITED STATES PATENT AND TRADEMARK OFFICE

CERTIFICATE OF CORRECTION

PATENT NO. : 5,934,245

DATED : August 10, 1999

INVENTOR(S) : Miller et al.

It is certified that error appears in the above-identified patent and that said Letters Patent is hereby corrected as shown below:

In Claim 10, line 22, after the word "blocked", please delete the punctuation mark ".", and insert in its place the phrase --; and an electronically controlled hydraulic actuator coupled to said gas valve member.--.

In Claim 14, lines 1 and 2, please delete the phrase "further comprising a hydraulic actuator coupled to said gas valve member; and" and insert the word --wherein--.

Signed and Sealed this

Fourteenth Day of December, 1999

*Attest:*

*Attesting Officer*

Q. TODD DICKINSON

*Acting Commissioner of Patents and Trademarks*